US005759146A

United States Patent [19]

Wilkinson

[11] Patent Number: 5,759,146

[45] Date of Patent: Jun. 2, 1998

[54] METHOD AND APPARATUS FOR MAKING SHRINK PACKAGE

[75] Inventor: Frank G. Wilkinson, Wooster, Ohio

[73] Assignee: KPC/Master's Craft International, Inc., Wooster, Ohio

[21] Appl. No.: 519,968

[22] Filed: Aug. 28, 1995

[51] Int. Cl.[6] ..... B65B 53/00

[52] U.S. Cl. ..... 493/349; 493/356; 493/231; 493/223; 493/243; 493/84; 53/441; 53/556; 53/589

[58] Field of Search ..... 493/84, 86, 93, 493/97, 94, 96, 98, 99, 100, 102, 109, 111, 120, 115, 122, 123, 125, 126, 128, 130, 131, 194, 210, 215, 217, 221, 223, 227, 336, 337, 343, 344, 348, 349, 355, 379, 382, 383, 386, 397, 405, 444, 68, 69, 79, 127, 151, 231, 203, 309, 310, 311, 352, 356, 409, 905, 918, 927, 932, 964, 162, 243; 53/427, 441, 556, 589, 593, 226, 372.7, 116, 117; 206/497, 466, 401

[56] References Cited

U.S. PATENT DOCUMENTS

| | | | |
|---|---|---|---|
| 3,470,814 | 10/1969 | Tschappu | 53/589 |
| 3,554,368 | 1/1971 | Nagel . | |
| 3,816,969 | 6/1974 | Zimmerman . | |
| 3,890,204 | 6/1975 | Avery | 206/461 |
| 4,328,896 | 5/1982 | Behne | 106/497 |
| 4,388,796 | 6/1983 | Zelnick | 53/441 |
| 4,403,695 | 9/1983 | Raymoure | 206/497 |
| 4,411,364 | 10/1983 | Friedman | 206/497 |
| 4,583,348 | 4/1986 | Treiber | 53/441 |
| 4,700,528 | 10/1987 | Bernard | 206/497 |
| 4,722,167 | 2/1988 | Jahn | 53/441 |
| 4,827,694 | 5/1989 | Owen | 53/441 |
| 4,932,930 | 6/1990 | Coalier | 493/127 |
| 4,958,480 | 9/1990 | Warner . | |
| 5,009,057 | 4/1991 | Wilkinson | 53/439 |
| 5,259,170 | 11/1993 | Tolson | 53/556 |
| 5,348,526 | 9/1994 | Feygin | 493/405 |
| 5,383,326 | 1/1995 | Dean | 53/556 |
| 5,460,861 | 10/1995 | Vicik | 428/34.9 |
| 5,467,873 | 11/1995 | Kastenhofer | 206/466 |
| 5,518,119 | 5/1996 | Takahashi | 206/497 |

*Primary Examiner*—Joseph J. Hail, III
*Assistant Examiner*—Christopher W. Day
*Attorney, Agent, or Firm*—Timmons & Kelly

[57] ABSTRACT

A system (A) for making shrink packaging (P) that is adapted to receive an article (O) to be packaged is disclosed including a conveyer (250) for moving a rigid substrate pallet member (250) beneath a flexible wrapping feed (252) that extends a flexible wrapping material (172) over a top surface (254) of the rigid substrate. An extension assembly (256) extends a desired length of the flexible wrapping material (172) from a flexible wrapping material supply (258) over the top surface (254) of the rigid substrate forming a pocket (178) between the top surface (254) of the rigid substrate and a bottom surface (180) of the flexible wrapping material (172). A trimmer (260) cuts the desired length of the extended flexible wrapping material (172) from the flexible wrapping material supply (258). The two opposing ends (174 and 176) of the length of the flexible wrapping material (172) is attached to the opposing ends (168 and 170) of the rigid substrate. A tuck (262) is inserted in the flexible wrapping material (172) between the opposing ends (174 and 176).

11 Claims, 6 Drawing Sheets

METHOD AND APPARATUS FOR MAKING SHRINK PACKAGE

BACKGROUND OF THE INVENTION

1. Technical Field

The invention relates to the field of shrink wrapped pallets and to methods and apparatus for preparing shrink wrapped pallets for securing objects.

2. Background Art

The process of shrink wrapping articles is well known in the art. Typically, the article or collection of articles to be wrapped is first covered with a shrink film such as polyvinyl chloride or polypropylene soft shrink material. The wrapped article is then located within a surrounding environment that causes the shrink film to shrink or contract about the article. Typically, the air surrounding the wrapped article is heated to between 275° F. and 350° F. and blown onto the shrink film covered article while it is conveyed through a shrink tunnel. The hot air shrinks the shrink film onto the article. If the article happens to be flat and flimsy or easily warped or curled or bent, then the pressure exerted on the article by the shrinking shrink wrap is frequently enough to cause distortion or bending of the article.

Alternatively, if one wishes to wrap larger or heavier articles, then one faces a similar set of problems as with small or flimsy articles. Bulky articles may be difficult to pass through the shrink tunnel or need additional support for transportation. Adding a backer board may provide necessary support, but may also reduce the efficiency of the shrink process by absorbing the heat used to shrink the shrink wrap.

Additionally, the typical shrink wrap that has been used heretofore is not reusable. Once the article to be wrapped has the shrink film shrunk about it, the user normally tears the shrink wrap in the removal process. Nor can the shrink wrap normally be reused for an article having even slightly different dimensions due to the shrink wrap matching the contours of the article about which it is shrunk.

Relating to the collapsible boxes known prior to the present invention, typically the foldable cardboard boxes such as those manufactured by Fellowes Manufacturing Co. of Itasca, Ill. 60143 are assembled by folding a series of flaps to form a box with sides having holes for carrying the box by the user. However, these typical types of storage boxes have no means to secure objects placed within the box from slipping about the carton. If articles were loosely placed in such boxes, the articles would move within the box as the box is turn upside down or otherwise undesirably moved. No means are typically provided to "lock-in" an article to be transported within the box.

DISCLOSURE OF INVENTION

In accordance with the present invention, an improved container for suspension of a selected object to be secured is disclosed. Containers of such type generally include a bottom member, a front side extending upwardly from a front edge of the bottom, a back side extending upwardly from a back edge of the bottom, a first side extending upwardly from a first edge of the bottom and between a first edge of the front and a first edge of the back, and a second side extending upwardly from a second edge of the bottom and between a second edge of the front and a second edge of the back. An inner chamber is formed between the bottom, the front and back, and the first and second sides.

A first extension flap extends from an upper edge of the first side. The first extension flap has an inner surface while the first side has an inner surface. The first extension flap is pivotable about an upper first axis parallel to a plane formed by the bottom, and the first extension flap can be moved into a locked position in which the inner surface of the first extension flap is adjacent the inner surface of the first side.

Similarly, a second extension flap extends from an upper edge of the second side. The second extension flap has an inner surface and the second side has an inner surface. The second extension flap is pivotable about an upper second axis parallel to a plane formed by the bottom, and the second extension flap can be moved into a locked position in which the inner surface of the second extension flap is adjacent the inner surface of the second side.

A first locking gap is formed between a locking edge of the first extension flap, the inner surface of the first side, and an upper surface of the bottom when the first extension flap is in the locking position. A portion of the object to be secured in the inner chamber is received in the first locking gap. Similarly, a second locking gap is formed between a locking edge of the second extension flap, the inner surface of the second side, and an upper surface of the bottom when the second extension flap is in the locking position for receiving a portion of the object to be secured in the inner chamber.

A shrink-wrapping pallet for protecting packages is also disclosed. The shrink-wrapping pallet of the present invention includes a pallet member that is formed having essentially rigid first and adjacent second sections. The first section and the second section each include an upper and a lower surface and opposing inner and outer edges. The first and second sections of the pallet member are joined along the inner edge of the first section and the inner edge of the second section. The pallet member is adapted to hold a selected object to be secured on the upper surface of the first section of the pallet member.

A flexible film that has first and second ends is secured to the pallet member near the outer edges of the first and the second sections of the pallet member. A pocket that is adapted to hold the object to secured is formed between the upper surface of the first section of the pallet member and an opposing lower surface of the film Further, the pallet member is adapted to fold between the first section and the second section along a primary axis between the inner edge of the first section and the inner edge of the second section of the pallet member. The second section rotates about the primary axis such that the lower surface of the second section can move into an opposing relationship to the lower surface of the first section. The rotation of the second section tightens the film about the selected object to be wrapped and consequently reduces the size of the pocket.

Also disclosed is a method and an apparatus for making the shrink packaging of the present invention that is adapted to receive an article to be packaged. The shrink package making apparatus includes a conveyer for moving a rigid substrate beneath a flexible wrapping feed that extends a flexible wrapping material over a top surface of the rigid substrate. An extension assembly extends a desired length of the flexible wrapping material from a flexible wrapping material supply over the top surface of the rigid substrate forming a pocket between the top surface of the rigid substrate and a bottom surface of the flexible wrapping material. A trimmer cuts the desired length of the extended flexible wrapping material from the flexible wrapping material supply. The two opposing ends of the length of the flexible wrapping material is attached to the opposing ends of the rigid substrate. A tuck is inserted in the flexible wrapping material between the opposing ends.

The present invention differs from the known types of packaging such as sleeve wrapping, bundle wrapping and skin wrapping in that a package can be opened and reclosed without the use of additional machinery. The present invention is also likely to be a fraction of the cost of the following known types of packaging: "foam in place," molded polyethylene, polypropylene styrene, urethane foam, air bladders, and styrene dunnage. Additionally, both the rigid substrate forming the pallet member and the flexible film of the present invention can be recycled.

These and other objects, advantages and features of this invention will be apparent from the following description taken with reference to the accompanying drawings, wherein is shown the preferred embodiments of the invention.

BRIEF DESCRIPTION OF DRAWINGS

A more particular description of the invention briefly summarized above is available from the exemplary embodiments illustrated in the drawing and discussed in further detail below. Through this reference, it can be seen how the above cited features, as well as others that will become apparent, are obtained and can be understood in detail. The drawings nevertheless illustrate only typical, preferred embodiments of the invention and are not to be considered limiting of its scope as the invention may admit to other equally effective embodiments.

MODES(S) FOR CARRYING OUT THE INVENTION

Figure 1:
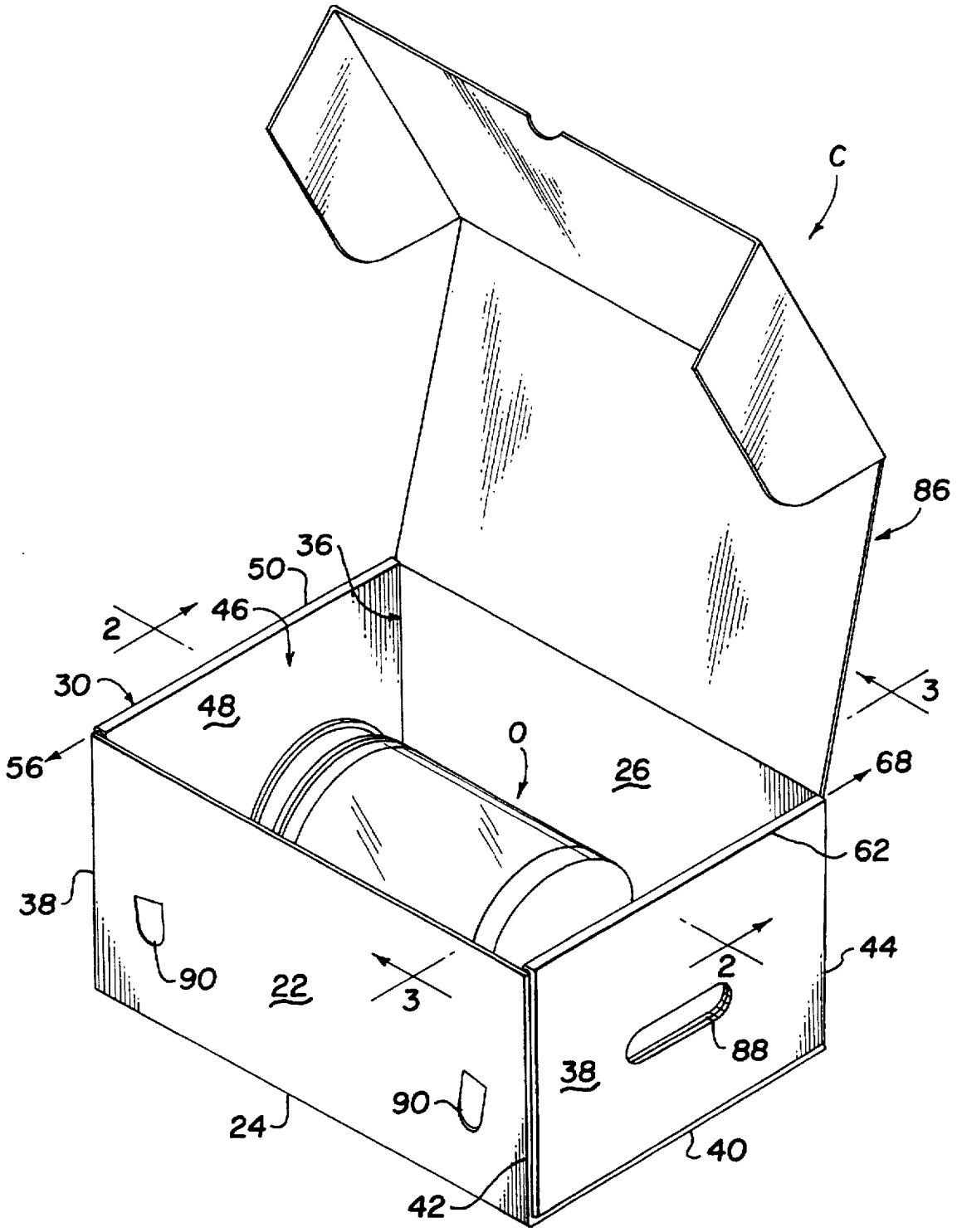
FIG. 1 is a front elevational view of the container of the present invention holding a selected object in the interior of the container.
Figure 3:
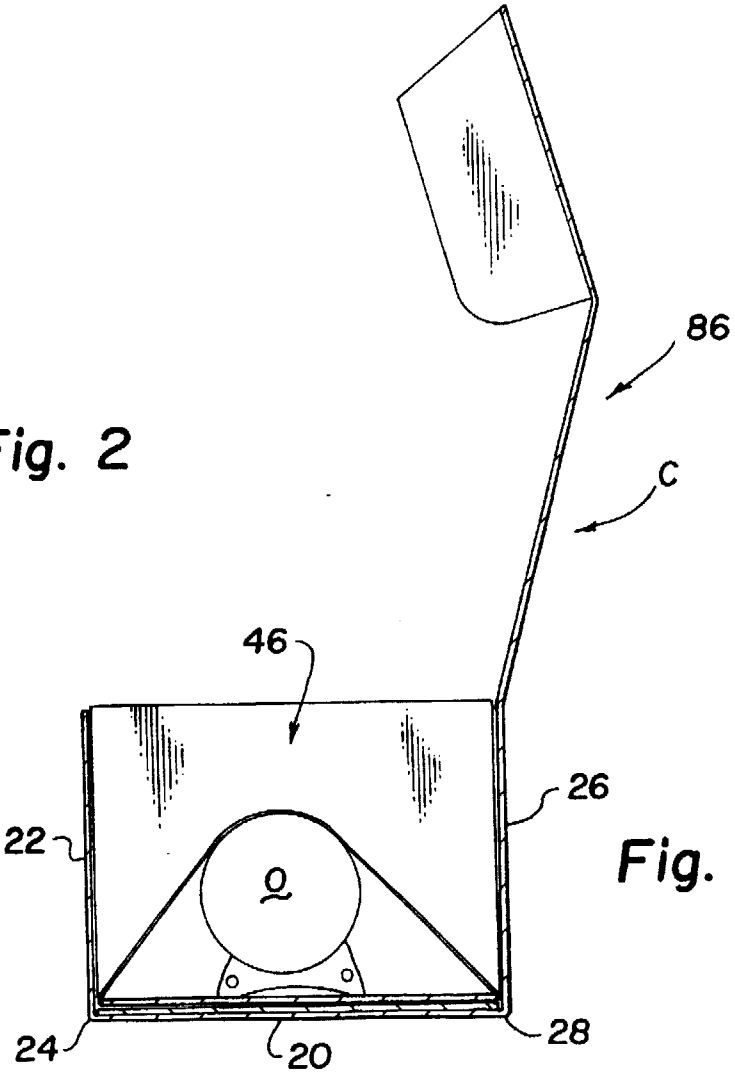
FIG. 3 is a cross sectional view of the container taken along line 3—3 of FIG. 1.

So that the manner in which the above recited features, advantages and objects of the present invention are attained can be understood in detail, more particular description of the invention, briefly summarized above, may be had by reference to the embodiment thereof that is illustrated in the appended drawings. In all the drawings, identical numbers represent the same elements.

Container for Securing Objects

Referring in particular to FIGS. 1–5, an improved container C for suspension of a selected object O to be secured is disclosed. Known containers of such type generally include a bottom member 20, a front side 22 extending upwardly from a front edge 24 of the bottom 20, a back side 26 extending upwardly from a back edge 28 of the bottom 20, a first side 30 extending upwardly from a first edge 32 of the bottom 20 and between a first edge 34 of the front 22 and a first edge 36 of the back 26, and a second side 38 extending upwardly from a second edge 40 of the bottom 20 and between a second edge 42 of the front 22 and a second edge 44 of the back 26. An inner chamber 46 is formed between the bottom 20, the front 22 and back 26, and the first and second sides 30 and 38, respectively.

A first extension flap 48 extends from an upper edge 50 of the first side 30. The first extension flap 48 has an inner surface 52 while the first side 30 also has an inner surface 54. The first extension flap 48 is pivotable about an upper first axis 56 parallel to a plane formed by the bottom 20, and the first extension flap 48 can be moved into a locked position 58 in which the inner surface 52 of the first extension flap 48 is adjacent the inner surface 54 of the first side 30. Similarly, a second extension flap 60 extends from an upper edge 62 of the second side 38. The second extension flap 60 has an inner surface 64 and the second side 38 has an inner surface 66. The second extension flap 60 is pivotable about an upper second axis 68 parallel to a plane formed by the bottom 20, and the second extension flap 60 can be moved into a locked position 70 in which the inner surface 64 of the second extension flap 60 is adjacent the inner surface 66 of the second side 38.

A first locking gap 72 is formed between a locking edge 74 of the first extension flap 48, the inner surface 54 of the first side 30, and an upper surface 76 of the bottom 20 when the first extension flap 48 is in the locking position 58. A portion 78 of a first object O to be secured in the inner chamber 46 is received in the first locking gap 72. For example, an edge or a portion of a pallet member 150, as described in more detail below, may be engaged or retained hi the locking gap 72. Similarly, a second locking gap 80 is formed between a locking edge 82 of the second extension flap 60, the inner surface 66 of the second side 38, and the upper surface 76 of the bottom 20 when the second extension flap 60 is in the locking position 70 for receiving a different portion 84 of the first object O to be secured in the inner chamber 46.

The container or box C of the present invention may optionally include or be formed having a top member 86 to enclose the inner chamber 46 fully.

Desirably, an aperture 88 may be formed in one or more sides of the container C, such as in first side 30 and second side 38. The user or carrier of the container C would place their fingers through the apertures 88 to grip and carry the box C.

Preferably, at least one locking finger 90 is formed in one or more sides of the container C, such as front 22 or rear 26. Each locking finger 90 extends into the inner chamber 46 to retain a portion of the object O to be secured from undesired movement in the inner chamber. Typically, a "U" shaped cut will be made in the wall forming the finger and the bottom of the "U" cut is pushed slightly into the interior of the inner chamber 46.

In yet another embodiment, the locking edge 74 may include a projection member 92 to retain the locking edge 74 in a spaced apart relationship or at a selected distance from the inner surface 54 of the first side 30 when the first extension flap 48 is placed in the locking position 58. The projection member 92 may be a block of wood or one or more compression springs glued or otherwise attached to the inner surface 52 of the first extension flap 48 or a flap 96 pivotally mounted to the locking edge 74.

Likewise, the locking edge 82 of the second extension flap 60 may include a projection member 98 to retain the corresponding locking edge 82 in a spaced apart relationship or at a selected distance from the inner surface 66 of the second side 38 when the second extension flap 60 is placed hi the locking position 70. The projection member 98 may also be a block of wood glued or otherwise attached to the inner surface 64 of the second extension flap 60 or a flap 100 pivotally mounted to the locking edge 82.

Figure 2:
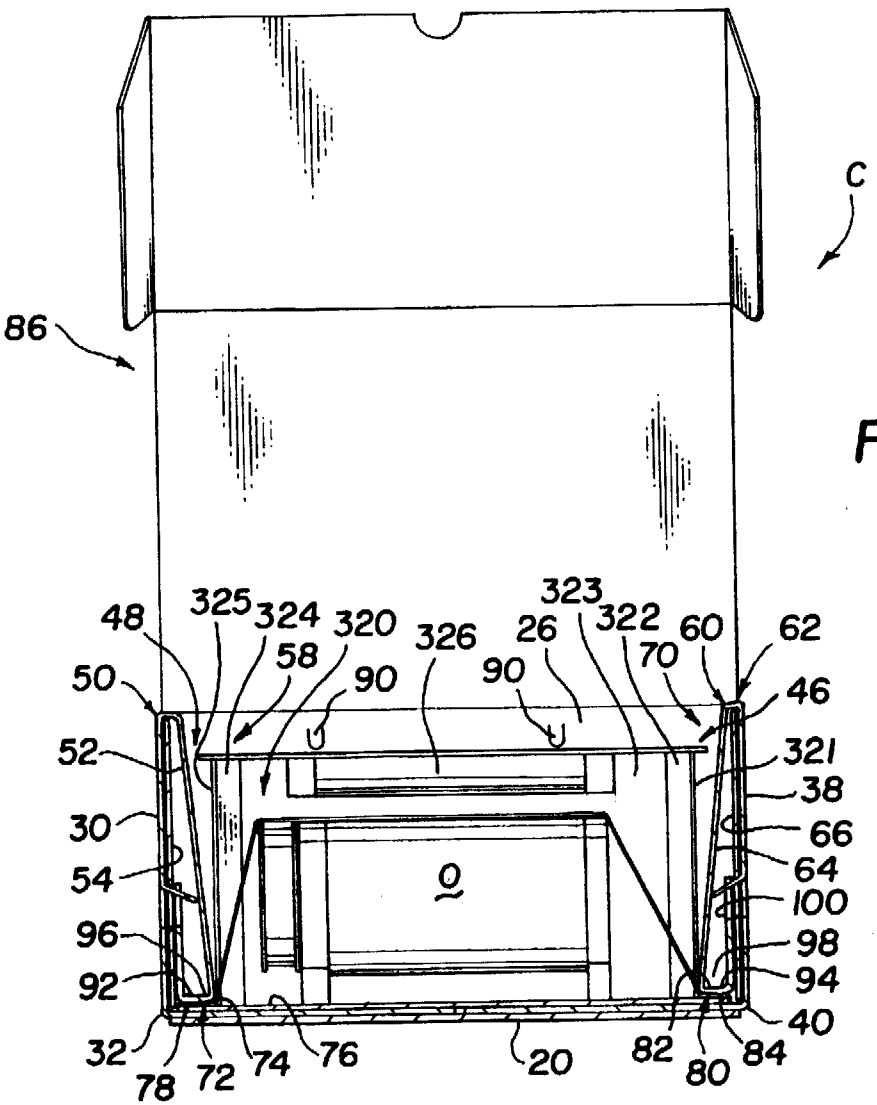
FIG. 2 is a cross sectional view of the container taken along line 2—2 of FIG. 1 and includes a second object in the interior of the container.

Referring to FIG. 2, the box or container C of the present invention may optionally include a spacer support member 320 having at least three essentially planar sides 321 through 325 perpendicular to the bottom 20 and forming a support at the top of the spacer member 320 and within the inner chamber 46 for a second object or load 326 to be secured. The spacer member 320 maintains the second article 326 in à spaced apart relationship from the first object O to be secured. The spacer member 320 is desirably formed from a sheet of corrugated fiberboard that has been scored to assist in proper folding of the sheet forming the sheet into a closed, hollow column or an open sided column that is placed around and over the first object O. The second object 326 to be secured is then placed on or suspended from the top of the spacer member 320 and extends into the hollow interior of the spacer member that was formed into the column. The second object 326 can be further secured by bending upper locking fingers 90 into the inner chamber 46 to lock or secure the second object 326 into the spaced apart position from the first object O.

Figure 4:
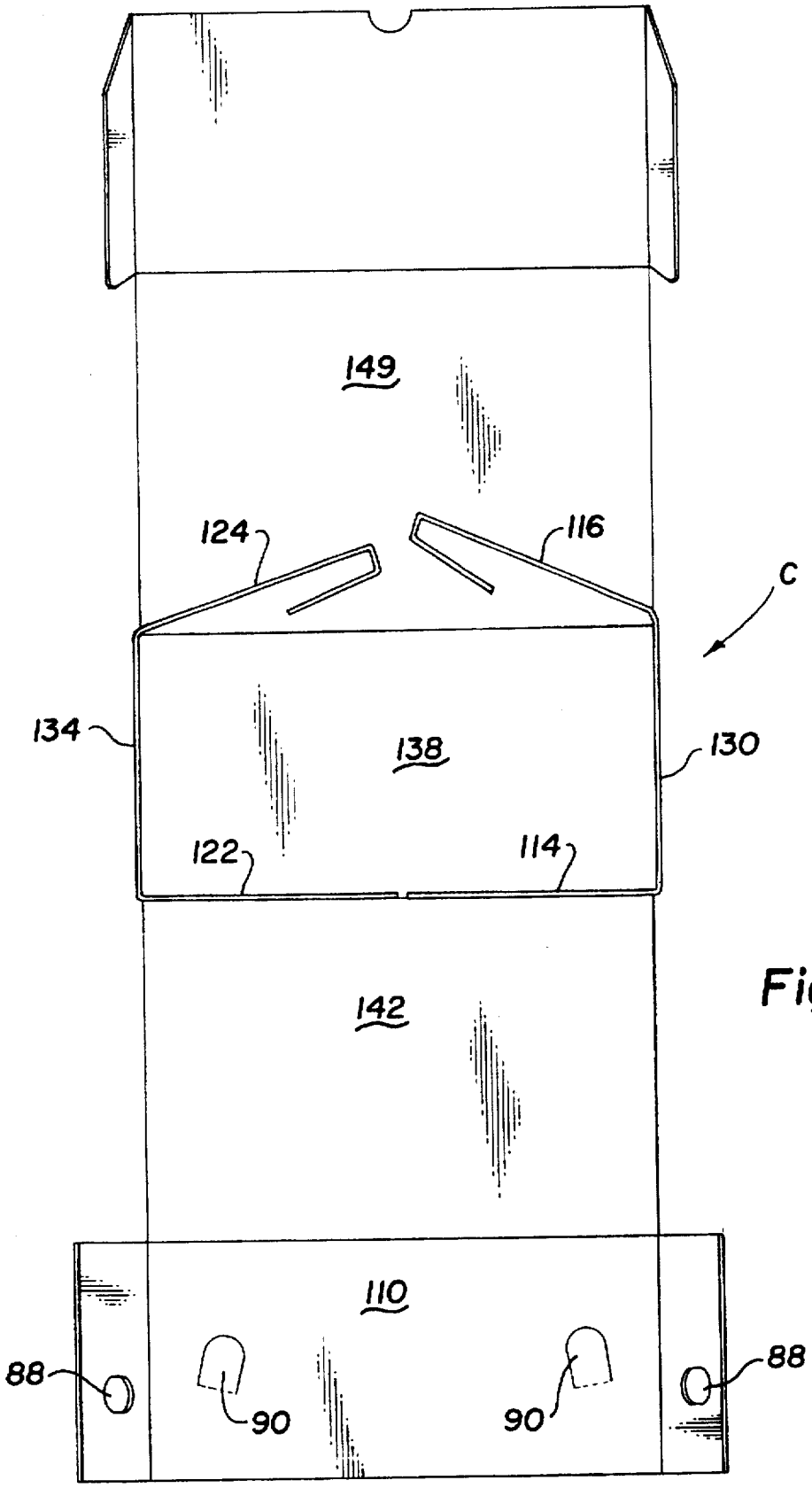
FIG. 4 is a plan view of the container of the present invention having been partially unfolded.
Figure 5:
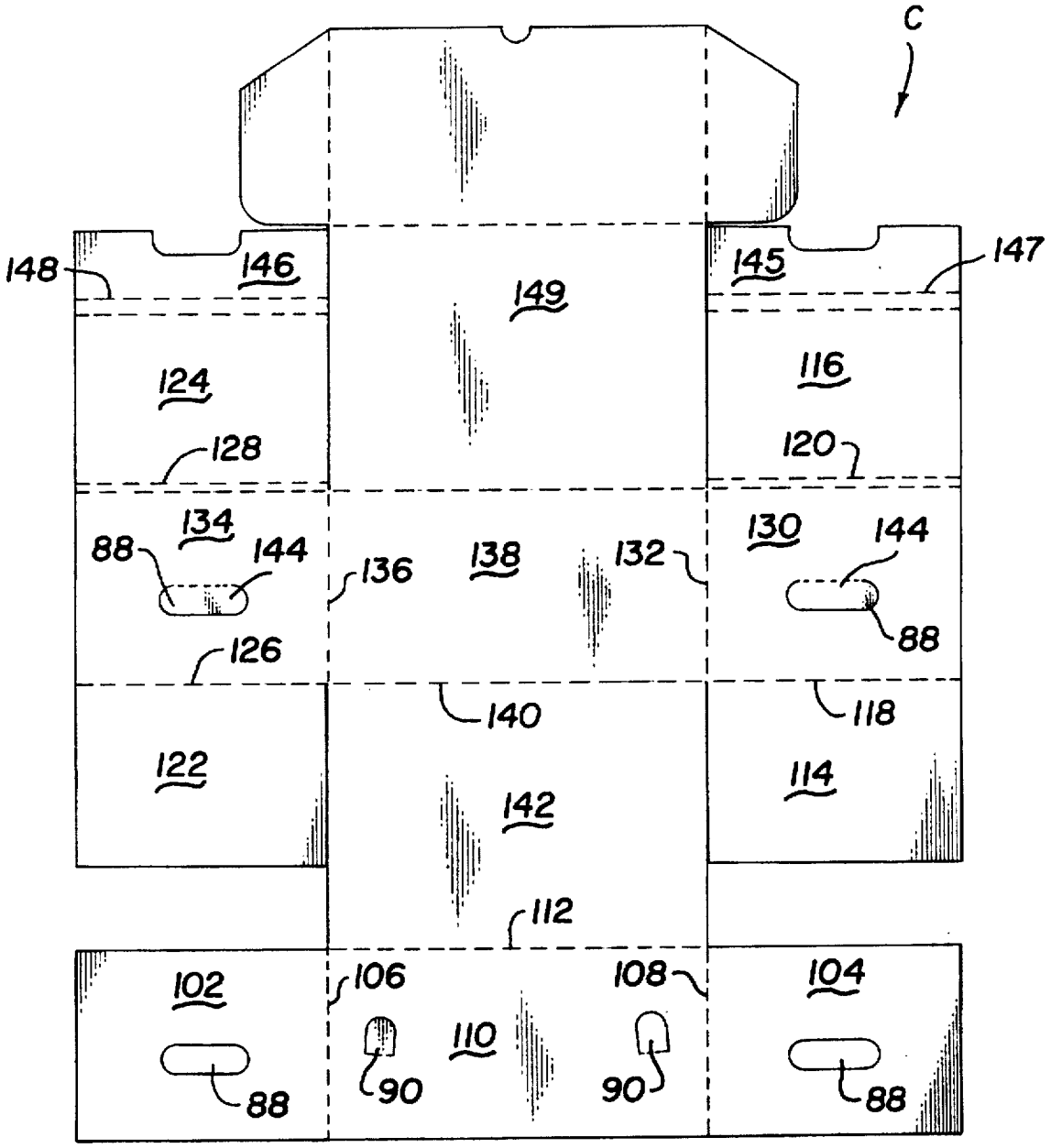
FIG. 5 is a plan view of a completely unfolded container of the present invention.
Figure 6:
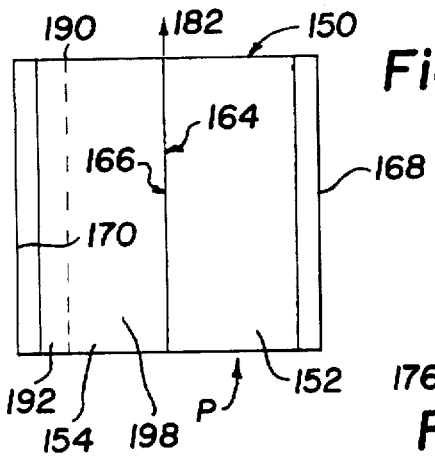
FIG. 6 is a top view of the pallet for shrink wrapping of the present invention.
Figure 7:
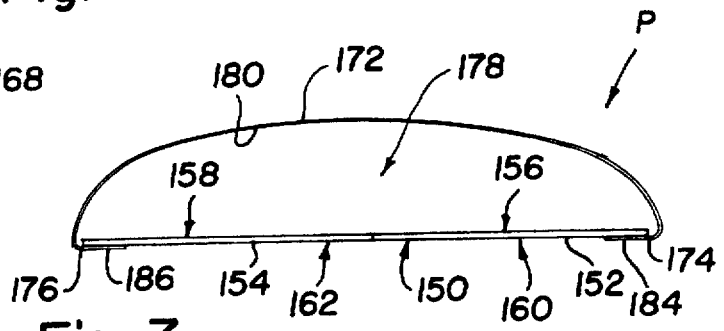
FIGS. 7 through 11 are side views of one embodiment of the pallet for shrink wrapping of the present invention showing the second section of the pallet member at various rotational positions.
Figure 8:
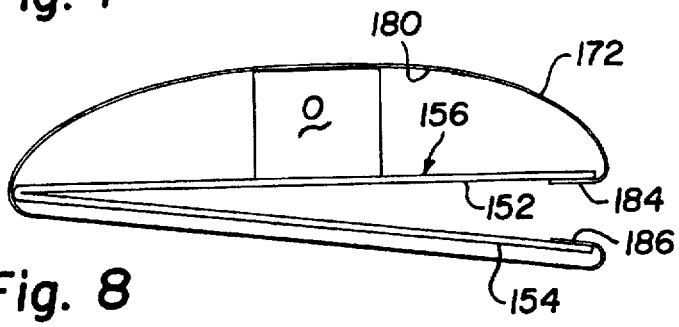
Figure 9:
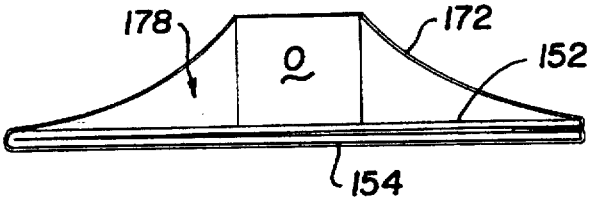

Referring now in particular to FIGS. 4 and 5 that show a collapsed or unfolded container C, directions for folding or forming one embodiment of the box C of the present invention will be given using a series of flaps and folding lines. Typically, the box is constructed from a single sheet of corrugated fiberboard or cardboard. Referring to FIG. 5, the dotted folding lines shown typically are scored lines in the cardboard to assist in folding of the flaps.

First, flap 114 is folded upwards ninety degrees about folding line 118, and then flap 130 is folded ninety degrees upwardly about folding line 132. Correspondingly, flap 122 is folded upwards ninety degrees about folding line 126, and then flap 134 is folded ninety degrees upwardly about folding line 136. See FIG. 4 showing the folding of the box at this stage. Flap 138 is folded upwardly ninety degrees about folding line 140 placing the lower surfaces of flaps 122 and 114 on top of flap 142. Flaps 102 and 104 are folded upwardly ninety degrees about folding lines 108 and 106, then flap 110 is folded upwardly ninety degrees about folding line 112 with flaps 102 and 104 being placed inside the box and inside of flaps 130 and 134. Aperture flaps 144 may then be folded into the interior of the box to lock the sides together and to form the aperture 88 for gripping the box.

Flaps 145 and 146 are folded about folding lines 147 and 148, respectively, to form the projection members. The object O to be secured is then placed in the inner chamber of the box and flaps 116 and 124 are then folding down about folding lines 120 and 128 into the locking position.

Finally, the optional top flap 149 may be folded into place to close the box.

Shrink-Wrapping Pallet

Referring now in particular to FIGS. 6 through 11, a shrink-wrapping pallet or core back pack P for protecting packages O of the present invention includes a pallet member 150 that is formed having essentially rigid first 152 and adjacent second 154 sections composed of a rigid substrate material. The first section 152 and the second section 154 each include an upper 156 and 158, respectively, and a lower 160 and 162, respectively, surface and opposing inner 164 and 166, respectively, and outer 168 and 170, respectively, edges. The first and second sections 152 and 154 of the pallet member 150 are joined along the inner edge 164 of the first section 152 and the inner edge 166 of the second section 154. The pallet member 150 is adapted to hold a selected object O to be secured on the upper surface 156 of the first section 152 of the pallet member 150.

Preferably, the pallet member 150, the first section 152 and the second section 154 are in the shape of parallelograms. However, the size or shape of the first section 152 does not have to be the same as the second section 154, so long as the two sections 152 and 154 may be joined.

A flexible film 172 that has first and second ends 174 and 176, respectively, is secured to the pallet member 150 near the outer edges 168 and 170 of the first 152 and the second sections 154 of the pallet member 150. The length of the film 172 between ends 174 and 176 is preferably longer than said pallet member when the pallet member 150 is in the flat position. See FIG. 7.

A pocket 178 that is adapted to hold the object O to secured is formed between the upper surface 156 of the first section 152 of the pallet member 150 and an opposing lower surface 180 of the film 172.

The pallet member 150 is also adapted to fold between the first section 152 and the second section 154 along a primary axis 182 between the inner edge 164 of the first section 152 and the inner edge 166 of the second section 154 of the pallet member 150. Generally, the primary axis 182 is parallel to the outer edges 168 and 170 of the first and second sections 152 and 154, respectively. The second section 154 rotates about the primary axis 182 such that the lower surface 162 of the second section 154 can move into an opposing relationship to the lower surface 160 of the first section 152. See FIG. 8. The rotation of the second section 154 tightens the film 172 about the selected object O to be wrapped and consequently reduces the size of the pocket 178.

One embodiment of the shrink-wrapping pallet P comprises a pallet member 150 forming a single sheet of a corrugated fiberboard having been scored along primary axis 182 for ease in pivoting or folding of the second section 154 about first section 152.

The pallet member 150 of an alternative embodiment includes two separate pieces of plywood or other rigid material that are hinged together with a rubber, plastic, leather, metallic or other type of hinge located between the first section 152 and the second section 154. Such an embodiment may be appropriate for heavier items, such as transmissions for automobiles, by way of example.

In yet another alternative, the first section 152 is formed having a tray member 188 for holding one or more smaller objects O. See FIG. 9.

Figure 10:
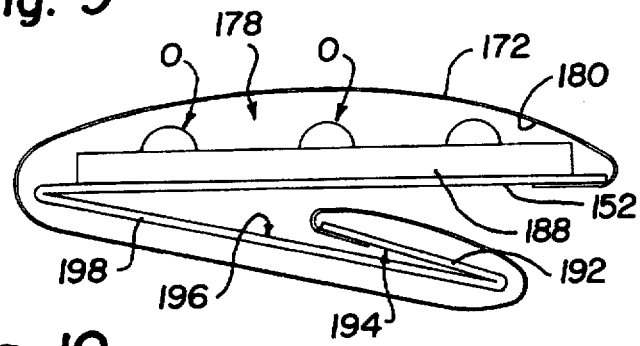
Figure 11:
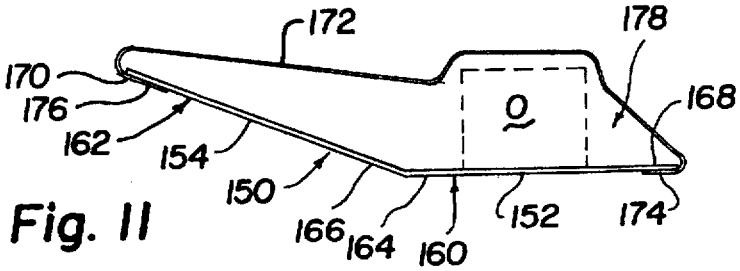

A secondary folding axis 190 may optionally be formed in second section 154. Such secondary axis 190 would be located between inner edge 166 and outer edge 170 of the second section 154. On outer portion 192 of the second section 154 may be folded about the secondary axis or score line 190 as is shown in FIG. 10. Rotating the outer portion 192 of the second section 154 about the secondary axis 190 into a position in which the lower surface 194 of the outer portion 192 is adjacent the lower surface 196 of an inner portion 198 of the second section 154 reduces the pocket 178 and tightens the flexible film 172 about the object O to be secured. Also, rotating the lower surface 194 of the outer portion 192 away from the inner portion's lower surface 196 enlarges the pocket 178.

The rigid substrate material forming the pallet member 150 can be of any form of rigid material including such materials as chip-board, corrugated fiberboard, plastic sheets, and plywood. The flexible film 172 generally controllably shrinks when it is exposed to selected conditions, such as a heat source. The film 172 may be, for example, any polypropylene, PVC, linear low density polyethylene, or hybrid biaxially oriented shrink film. The flexible film 172 may be attached to the pallet member by liquid glue, a glue spray or stapled.

Use of the Shrink-Wrapping Pallet

Generally, the pallet member 150 composed of the rigid substrate is given to the user with the film 172 attached to it at the edges 184 and 186 of the film 172. The user simply lifts up the film 172 forming the pocket 178, inserts the selected object or product O to be packaged, folds the second section 154 of the pallet member 150 downward, that is away from the product O, and passes the load through a known type of a shrink tunnel suitably sized. The film 172 shrinks tightly around the product or object O to be secured for transit purposes, for example. When the next user receives the shrink wrapped pallet package load, the user simply removes any shipping restraints, such as a box, unfolds the second section of the pallet and removes the product without having to cut the film 172.

If another similar product, or the old "to be replaced item," is to be returned, that second product is simply placed back under the film approximately in the position about which the film 172 has been deformed or molded about the former product. The second section 154 of the pallet is then folded downward again away from the product O making the film 172 once again tight without shrinking for reduced chances of damage in shipping the product back to the original shipper.

Apparatus for Forming Shrink Packages

Figure 12:
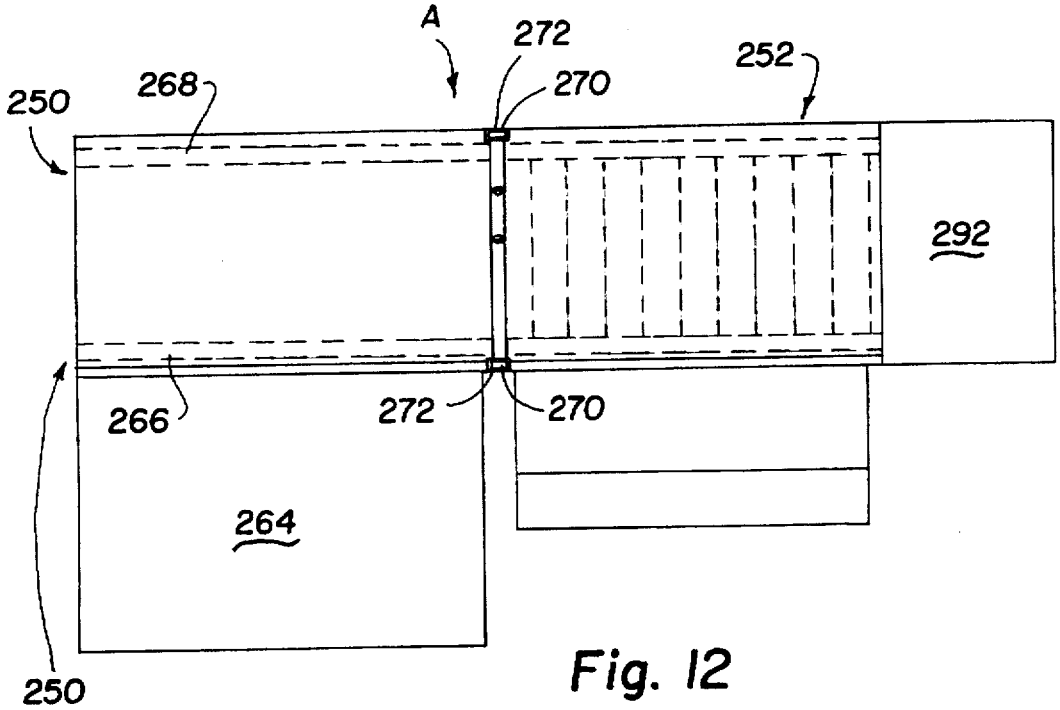
FIG. 12 is a top view of an apparatus according to the present invention for preparing the pallets for shrink wrapping.
Figure 13:
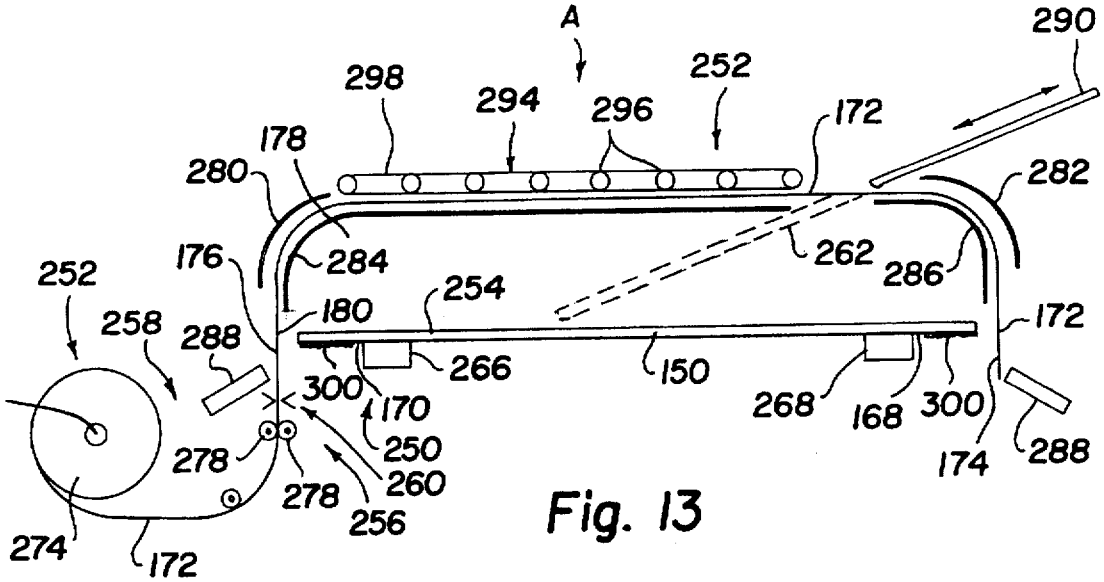
FIG. 13 is a cross sectional view of the apparatus for preparing the pallets for shrink wrapping.

Referring now to FIGS. 12–13, in general a system A for making shrink packaging P is adapted to receive an article O to be packaged. The present shrink package making apparatus A takes pre-cut to size substrate material, such as corrugated fiberboard, and scores it in one or more places. A conveyer 250 moves the pallet member 150 of the rigid substrate beneath a flexible wrapping feed assembly 252 that extends a flexible wrapping material 172 over a top surface 254 of the rigid substrate. An extension assembly 256 extends a desired length of the flexible wrapping material 172 from a flexible wrapping material supply 258 over the top surface 254 of the rigid substrate 150 forming a pocket 178 between the top surface 254 of the rigid substrate 150 and a bottom surface 180 of the flexible wrapping material 172. A trimmer 260 cuts the desired length of the extended flexible wrapping material 172 from the flexible wrapping material supply 258. The two opposing ends 174 and 176 of the length of the flexible wrapping material 172 is attached to the opposing ends 168 and 170 of the rigid substrate. A tuck 262 is inserted in the flexible wrapping material 172 between the opposing ends 174 and 180.

A vacuum feed rigid substrate hopper or loader 264 transfers the rigid substrate pallet member 150 in registration to preferably two vacuum belts 266 and 268 of the conveyer 250. One of the vacuum belts 266 may be of a fixed size, while the second vacuum belt 268 is preferably adjustable in order to accommodate various sizes of substrate pallet members 150.

One or more adjustable scoring wheels 270 are mounted after the loader 264. The scoring wheels 270 determine where the substrate pallet member 150 folds to create the opening and reclosing function of the package, as described above.

Two attaching heads 272 attach the flexible wrapping material 172 to the rigid substrate pallet member 150. The flexible wrapping material or film 172 may be glued, staple or stitch to the substrate pallet member 150. One attaching head 272 is mounted near the edge of each vacuum belt 266 and 268 and preferably directly across from each other.

A flexible material supply 258 includes one or more rolls 274 of the film 172 on racks 276 to allow for a controlled and smooth dispensing of the flexible material 172 as it is moved or extended across the substrate pallet member 150 prior to being attached. The flexible material feed 252 includes the flexible material supply 258 and a tensioning brake (not shown) to prevent the over-coasting or undesired length of the flexible film being pulled from the rolls 274.

A flexible material drive roller 278 peels the material off the roll or rolls 274 and feeds the film 172 into the plows as will be described. Two rigid outer forming plows or guides 284 and 286 with one on each side of the vacuum belts 266 and 268, respectively, direct the feeding of the film 172 over the rigid substrate pallet members 150 that were moved or positioned beneath the flexible wrapping material feed 252 by the vacuum conveyer 250. A mechanical or heated flexible material cut-off blade or trimmer 260 separates the desired length of film 172 from the remaining portion of the film from the rolls 274.

Generally, two adjustable height inner forming plows or guides 284 and 286 are mounted between the outer forming plows 280 and 282 and the vacuum conveyor belts 266 and 268 so as to not restrict the passage of the rigid substrate through the film feed assembly 252. The inner guides 284 and 286 support the film 172 from collapsing onto the top surface 254 of the rigid substrate as the film 172 is extended across the pallet member 150.

A film feeder segment 294 that is adapted to the film and the size of the substrate pallet member 150 feeds the flexible wrapping material 172 through the outer 280 and 282 and inner 284 and 286 plows or guides from one side 170 of the substrate pallet member 150 to the other side 168. Generally, the film feeder segment 294 includes several rollers 296 and one or more continuous belts 298 that frictionally engage the film 172.

One or more tuck plates 288 tuck the ends 174 and 176 of the flexible wrapping material 172 to the exposed underside edges 168 and 170 of the rigid substrate to secure the opposing ends 174 and 176 of the film to the pallet member 150.

A film fold tucking fin 290 pushes against the film 172 to insert a fold 262 into the loose flexible material 172 to take up any slack in the film about the pocket 178 that is formed between the upper surface 254 of the rigid substrate and the bottom or lower surface 180 of the film 172.

Finally, an accumulating, pallet stacking section 292 counts and stacks the finished packaging pallets for subsequent transportation and optionally banding and palletizing.

Operation of the Apparatus for Forming Shrink Packages

The operation of the above described apparatus for forming shrink packages of the present invention includes the following steps in generally the following order:

a. The film or flexible wrapping material 172 is driven into a forming plow 280 and 284 by the power drive rollers 278 bending it to the right as shown in FIG. 13.

b. The inserted end 174 of the film is picked up by a multi-belt film feeding segment 294 that pulls and pushes the film 172 to the opposite side of the width of the rigid substrate pallet member 150.

c. The film 172 is bent and is driven to a desired location below the rigid substrate pallet member 150 for attachment of the film to the bottom side 168 and 170 of the pallet member 150.

d. The mechanical or heated cut-off blade 260 cuts the flexible wrapping material just above the initial drive roller 278.

e. Generally, while steps a through d are performed, a rigid substrate pallet member 150 is positioned beneath the flexible wrapping material feed assembly 252 to receive the flexible material. The attaching agent 300, primarily glue, is applied to both exposed edges 168 and 170 on the underside of the rigid substrate pallet member 150.

f. Two mechanical tuckers 288, one from each side of the pallet member 150, press the flexible wrapping material 172 onto the glue 300 on the underside of the rigid substrate or is otherwise secured, such as by stapling.

g. The multi-belt feeding system 294 moves upward and out of the way.

h. The film fold tucking fin 290 folds the loose flexible material neatly on top of the finished pallet member 150 and then retracts.

i. Finally, the completed pallet advances forward for stack, bending, palletizing or other processing.

The foregoing disclosure and description of the invention are illustrative and explanatory thereof, and various changes in the size, shape and materials, as well as in the details of the illustrated construction may be made without departing from the spirit of the invention.

I claim:

1. A method for making a shrink package adapted to receive an article to be packaged, comprising in combination the steps of:

supplying a rigid substrate having a top surface and first and second opposed substrate ends;

conveying said rigid substrate beneath a flexible wrapping feed means for extending a flexible wrapping material over said top surface of said rigid substrate;

extending a desired length of said flexible wrapping material from a flexible wrapping material supply over said top surface of said rigid substrate to form a pocket between the top surface of the rigid substrate and a bottom surface of the flexible wrapping material;

trimming said extended flexible wrapping material to form a desired wrapping material length having first and second opposed wrapping material ends;

attaching said first and second opposed wrapping material ends to associated first and second opposed substrate ends;

forming a tuck in said flexible wrapping material between said first and second substrate ends such that the flexible wrapping material is inwardly folded over said top surface of said rigid substrate to form a shrink package comprised of a folded flexible wrapping material attached to said rigid substrate; and removing said shrink package from beneath said flexible wrapping feed.

2. The method of claim 1 wherein said first and second opposed wrapping material ends are glued to said associated first and second opposed substrate ends.

3. The method of claim 1 wherein said first and second opposed wrapping material ends are stapled to said associated first and second opposed substrate ends.

4. The method of claim 1 wherein said first and second opposed wrapping material ends are attached to an underside of said associated first and second opposed substrate ends.

5. The method of claim 1 including the step of attaching said rigid substrate to a conveyor belt for moving said substrate through said flexible wrapping feed.

6. The method of claim 1 including the step of scoring said rigid substrate in at least one location for folding of the rigid substrate.

7. An apparatus for making a shrink package adapted to receive an article to be packaged, comprising:

supplying means for supplying a rigid substrate having a top surface and first and second opposed substrate ends;

conveying means for moving said rigid substrate beneath a flexible wrapping feed means for extending a flexible wrapping material over said top surface of said rigid substrate;

extending means for extending a desired length of said flexible wrapping material from a flexible wrapping material supply over said top surface of said rigid substrate to form a pocket between the top surface of the rigid substrate and a bottom surface of the flexible wrapping material;

trimming means for separating the desired length of said extended flexible wrapping material from said flexibly wrapping material supply to form a desired wrapping material length having first and second opposed wrapping material ends;

attaching means for securing said first and second opposed wrapping material ends to associated first and second opposed substrate ends;

tuck forming means for inserting a tuck in said flexible wrapping material between said first and second substrate ends such that the flexible wrapping material is inwardly folded over said top surface of said rigid substrate to form a shrink package comprised of a folded flexible wrapping material attached to said rigid substrate; and removing means for removing said shrink package from beneath said flexible wrapping feed.

8. The method of apparatus of claim 7 wherein said first and second opposed wrapping material ends are glued to said associated first and second opposed substrate ends.

9. The method of apparatus of claim 7 wherein said first and second opposed wrapping material ends are stapled to said associated first and second opposed substrate ends.

10. The method of apparatus of claim 7 wherein said first and second opposed wrapping material ends are attached to an underside of said associated first and second opposed substrate ends.

11. The apparatus of claim 7 including means to score said rigid substrate in at least one location for folding of said rigid substrate.

* * * * *